US007770359B2

(12) United States Patent
Sauer et al.

(10) Patent No.: US 7,770,359 B2
(45) Date of Patent: Aug. 10, 2010

(54) BANDING SYSTEM AND PROCESS FOR BANDING PILED PRODUCTS

(75) Inventors: Hartmut Karl Sauer, Himmelstadt (DE); Philipp Ulrich Geringer, Winterhausen (DE); Gert Wilfried Otmar Lang, Rudenhausen (DE)

(73) Assignee: KBA-Giori S.A., Lausanne (CH)

( * ) Notice: Subject to any disclaimer, the term of this patent is extended or adjusted under 35 U.S.C. 154(b) by 0 days.

(21) Appl. No.: 12/369,988

(22) Filed: Feb. 12, 2009

(65) Prior Publication Data

US 2009/0211199 A1 Aug. 27, 2009

Related U.S. Application Data

(63) Continuation of application No. 10/591,063, filed as application No. PCT/IB2005/000540 on Mar. 3, 2005, now Pat. No. 7,506,492.

(30) Foreign Application Priority Data

Mar. 5, 2004 (EP) ..... 04005269

(51) Int. Cl.
*B65B 13/04* (2006.01)

(52) U.S. Cl. ..... 53/399; 53/580; 53/582

(58) Field of Classification Search ..... 53/397–399, 53/580, 582, 589, 591
See application file for complete search history.

(56) References Cited

U.S. PATENT DOCUMENTS

| | | | | | |
|---|---|---|---|---|---|
| 3,831,512 | A * | 8/1974 | Johnson | 100/26 |
| 3,939,621 | A | 2/1976 | Giori | |
| 4,283,902 | A | 8/1981 | Giori | |
| 4,453,707 | A | 6/1984 | Kuhfuss | |
| 4,817,804 | A | 4/1989 | Kawano et al. | |
| 5,168,686 | A * | 12/1992 | Guttinger | 53/399 |
| 5,755,084 | A | 5/1998 | Dekker | |
| 5,842,327 | A * | 12/1998 | Schwede | 53/540 |
| 5,890,423 | A * | 4/1999 | Lih | 100/26 |
| 5,927,047 | A | 7/1999 | Bartels | |
| 6,604,345 | B1 | 8/2003 | Langemaat | |
| 7,207,161 | B2 * | 4/2007 | Belmann et al. | 53/589 |
| 2003/0033941 | A1 | 2/2003 | Ozga et al. | |
| 2004/0163366 | A1 | 8/2004 | Muller | |
| 2005/0206063 | A1 | 9/2005 | Gosslinghoff | |

FOREIGN PATENT DOCUMENTS

| | | | |
|---|---|---|---|
| DE | 101 60 718 | A1 | 6/2003 |
| JP | 2001-171610 | A | 6/2001 |
| WO | 95/19913 | A1 | 7/1995 |
| WO | 2004/009448 | A1 | 1/2004 |

* cited by examiner

*Primary Examiner*—Christopher Harmon
(74) *Attorney, Agent, or Firm*—Crompton, Seager & Tufte, LLC

(57) ABSTRACT

A banding system for piled products with a machine frame, a band feed mechanism disposed on the machine frame for feeding band material from a supply roll, means for forming a loop with said band material around the products to be banded, welding means to close said loop, and cutting means for cutting said band material, said means for forming the loop comprising transporting means for transporting the band material around the product to be banded and vacuum means connected to the transporting means. Said means for forming the loop are movable with respect to machine frame between an operating position where the means for forming the loop are in contact with the band feed mechanism to perform the banding operation and an open position where the means for forming the loop are displaced away from the band feed mechanism to create an opening therebetween allowing a transfer of products to be banded between the band feed mechanism and the means for forming the loop.

24 Claims, 5 Drawing Sheets

21
9
8
7
20
19'
111a
222
19
10
5
18
111a'
22
50
4
1a
3
1b

BANDING SYSTEM AND PROCESS FOR BANDING PILED PRODUCTS

CROSS-REFERENCE TO RELATED APPLICATIONS

This application is a continuation of U.S. application Ser. No. 10/591,063 filed Nov. 17, 2006, now U.S. Pat. No. 7,506,492, which is the National Stage of International Application No. PCT/IB2005/000540, filed Mar. 3, 2005, the entire disclosures of which are both incorporated herein by reference.

FIELD

The present invention concerns a banding system for piled products, such as piled sheets of paper.

The present invention also concerns a banding process for piled products, such as piled sheets of paper.

BACKGROUND

Such systems are known in the art, in particular in the art of fabricating securities made of paper substrate or the like.

As a first example, U.S. Pat. No. 3,939,621, the content of which is enclosed by reference in the present application, discloses a method of processing sheets of printed security papers into bundles and packets. In this known process, sheets with printed numbered banknotes are supplied to a cutting machine in piles of 100 sheets. After trimming of edges of the pile, successive strips are cut in the pile, each strip having several banknotes in a row. In the given example, each sheet contains 24 printed banknotes arranged in four columns and six rows, thus four strips are produced with six banknotes each. A further cutting unit is provided which then cuts the strips into individual piles of 100 banknotes. The individual piles of 100 banknotes are then individually banded in a banding unit to produce banded bundles of 100 notes consecutively numbered.

U.S. Pat. No. 4,283,902 discloses another process and apparatus for converting piles of freshly printed sheets of banknotes into bundles of banknotes. The disclosed machine comprises as many banding devices as there are individual banknotes per strip, the banding devices operating simultaneously on each strip. Accordingly, the bundled strips are simultaneously provided with bands at all banknote positions, so that the bundles of banknotes leaving the last cutting tool are already banded and the narrow path which the banding station represented in the apparatus known hitherto is eliminated.

Another example is given by U.S. Pat. No. 4,453,707, the content of which is incorporated by reference in the present application, which relates to a method and device for automatically processing sheet piles of numbered multiple-note security papers, such a banknotes, into bundled packets.

A further example of a banding device and banding process is disclosed in PCT application WO 95/19913, corresponding to U.S. Pat. No. 5,755,084, both incorporated by reference in the present application. Said publications disclose a device for arranging a band of flexible material around at least one product, comprising a feed mechanism for feeding band material from a supply roll, means for forming a loop in an end portion of the band material round a space for receiving the product, means for severing that end portion and welding means for closing the loop, the means for forming the loop consisting of transporting means for the band material movable round the space and suction means connected to the transporting means.

In the described device, the band material is pushed up via a guide by feed and pulling rollers and then comes into contact with a perforated endless conveyor belt. The belt, driven by a motor, is in a casing in which a vacuum pump creates underpressure (vacuum) in a channel engaging round the belt. The perforated belt thus draws the band material until the leading end of the band is clamped by a clamp. A space is surrounded by the band material, said space being larger than the product to be banded placed herein. Feed and pulling rollers then tighten the band material until the band material fits around the product, the band material coming loose from the perforated belt. Finally, cutting and welding means close the loop of band material and sever it from the remaining band material. The product banded can be removed and the machine is ready for the following cycle.

This machine is however not practical when using it for banding a strip of notes in a simultaneous manner as is usual in the art of producing printed document such as securities. With several banding units arranged next to each other (as many banding units as single notes in the strip), the strip must be transported laterally under the successive banding units in order to be in place in banding position, which is very time consuming, since the means for forming the loop are rigidly connected to the machine body side.

Document DE 101 60 718 describes a banding system comprising means for forming a loop around the products to be banded which are movable upwardly and downwardly with respect to a stationary machine body so as to allow the products to be transferred in the banding position between an opening created between the means for forming the loop and the machine body. This document does not however disclose how the band material is or might be transported around the product, or how the means for forming the loop is operatively connected to the remaining of the machine. There is in particular no indication or suggestion in this document that the band material is or could be transported by means of a vacuum-assisted transport system. Moreover, in DE 101 60 718, the means for forming the loop are displaceable by means of a supporting frame oriented perpendicularly to the transport path of the band material and which therefore limits the dimensions, lengthwise (i.e. in the direction perpendicular to the transport path of the band material), of the products to be banded. This constructions also creates complications and is too bulky should one desire to dispose several banding system in parallel, in order for instance to band several portions of a same strip of piled products.

SUMMARY

It is therefore an aim of the present invention to improve the known devices and methods.

In particular, an aim of the present invention is provide a simple banding device and process.

A further aim of the present invention is to provide a banding device and process that are more efficient.

Another aim of the present invention is to provide a banding system that can be placed in existing machines.

To this effect, the invention complies with the definition of the claims.

BRIEF DESCRIPTION

The invention will be best understood by the description of one embodiment thereof and of the accompanying drawings in which:

FIG. 1 shows a general perspective view of the system according to the present invention;

FIG. 1*a* is a plan view of the banding system of FIG. 1;

FIG. 1*b* is a more detailed plan view of the banding system illustrated in FIGS. 1 and 1*a;*

DETAILED DESCRIPTION

Figure 1:
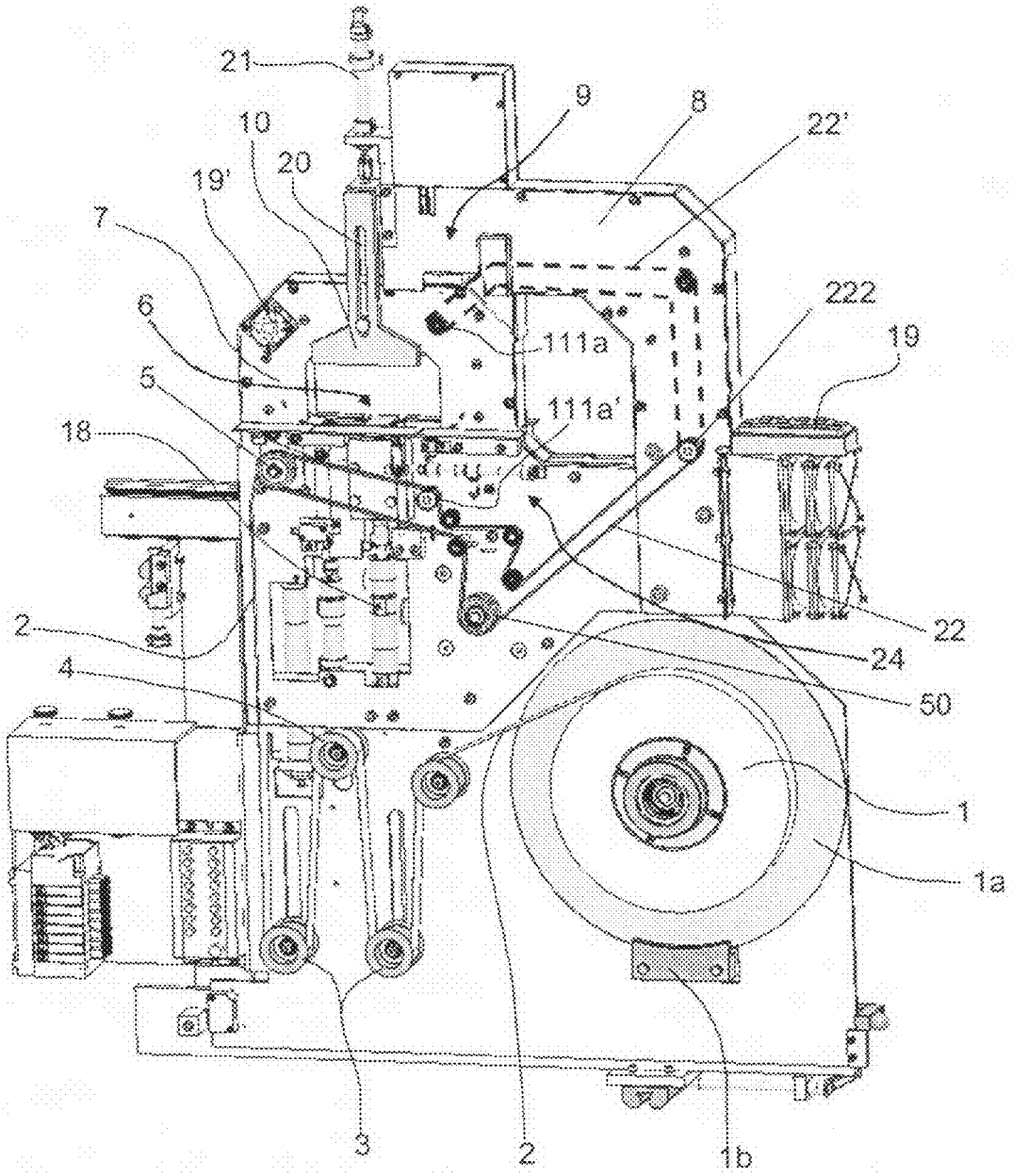

In FIG. 1, a general perspective view of the banding system according to the invention is shown in partial cut. The system comprises mainly a band reel 1 which is mounted on a rotatable reel support 1*a* and from which a band 2 is taken and goes through a band storage comprising first 3 and second 4 storage rolls. Reference 1*b* designates a brake system used to selectively stop rotation of the reel support 1*a* and associated band reel 1 as this will be explained hereinafter. The band is guided to a drive roll 5, driven by a motor 50 and transfer belt 22 (also illustrated in FIG. 1*a*), which is located under a band feed mechanism 6 through which the band is fed to means for forming a loop 7. Said means for forming a loop 7 are attached to frame 8 of the machine and may be displaced upwards and downwards on said frame 8 through sliding rail means 9 integrated in said frame, this motion being driven, for example by appropriate displacement means, such as a piston.

Another transfer belt mechanism (not shown in FIGS. 1 and 1*a*) for driving the band transporting means which are located in the means for forming the loop 7 (transporting rolls 111 and conveyor means 13 in FIGS. 1*b* and 2) is integrated in the upper part of the machine frame 8. This additional transfer belt mechanism is shown in greater details in FIG. 1*b* and comprises a transfer belt 22' coupled to rolls 222, 223 and 224. Rolls 222 and 223 are secured to the machine frame 8 while roll 224 is secured to the movable part of the banding system, i.e. the means for forming the loop 7. Roll 222 is connected both to the lower transfer belt 22 and the upper transfer belt 22' so that both transfer belt mechanisms are drivingly connected to each other in synchronism. Roll 224, on the other hand, is drivingly connected to the transporting means 111, 13 by a short transfer belt (not shown) connecting roll 224 and one 111*a* of the transporting rolls 111.

Figure 1A:
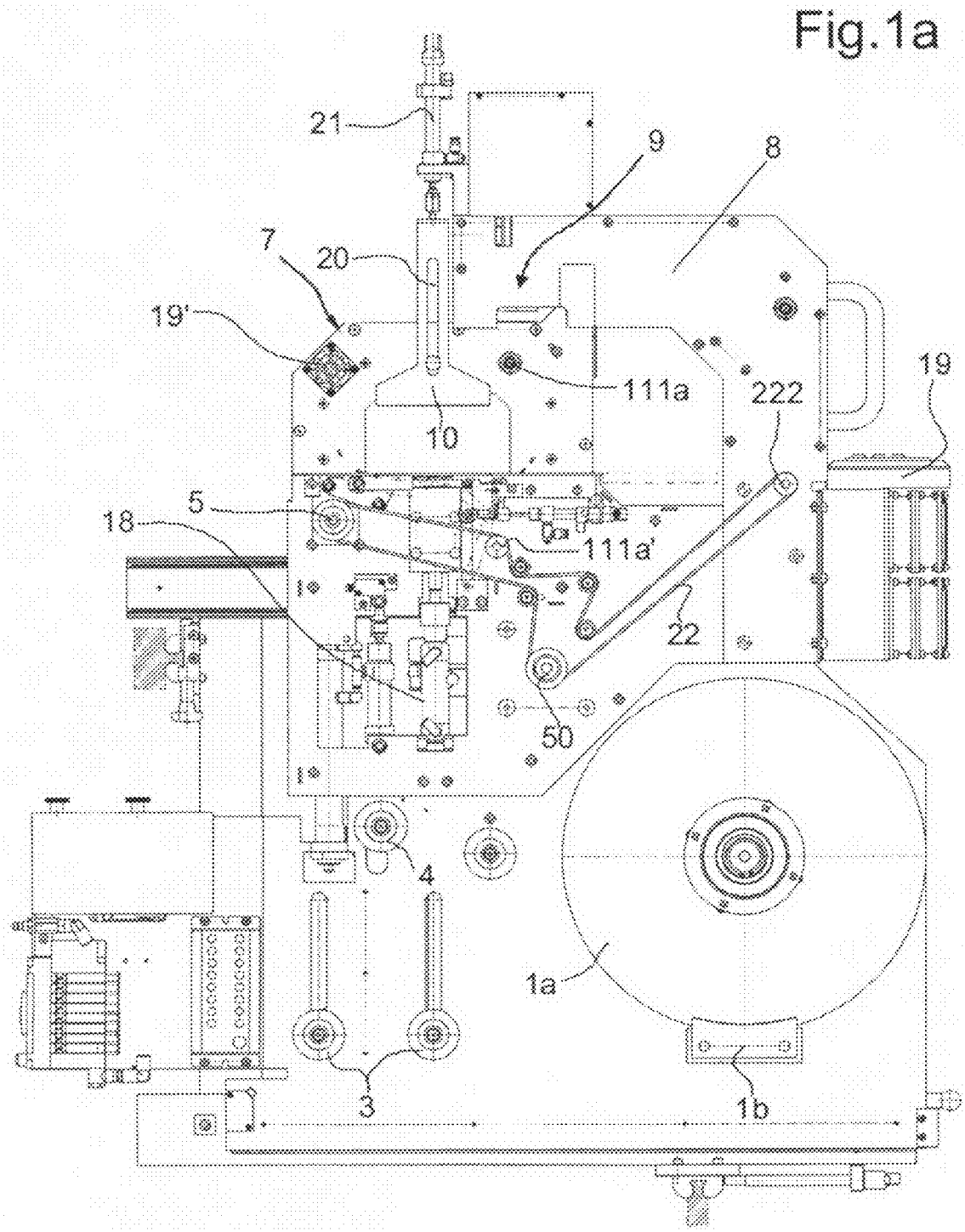
Figure 1B:
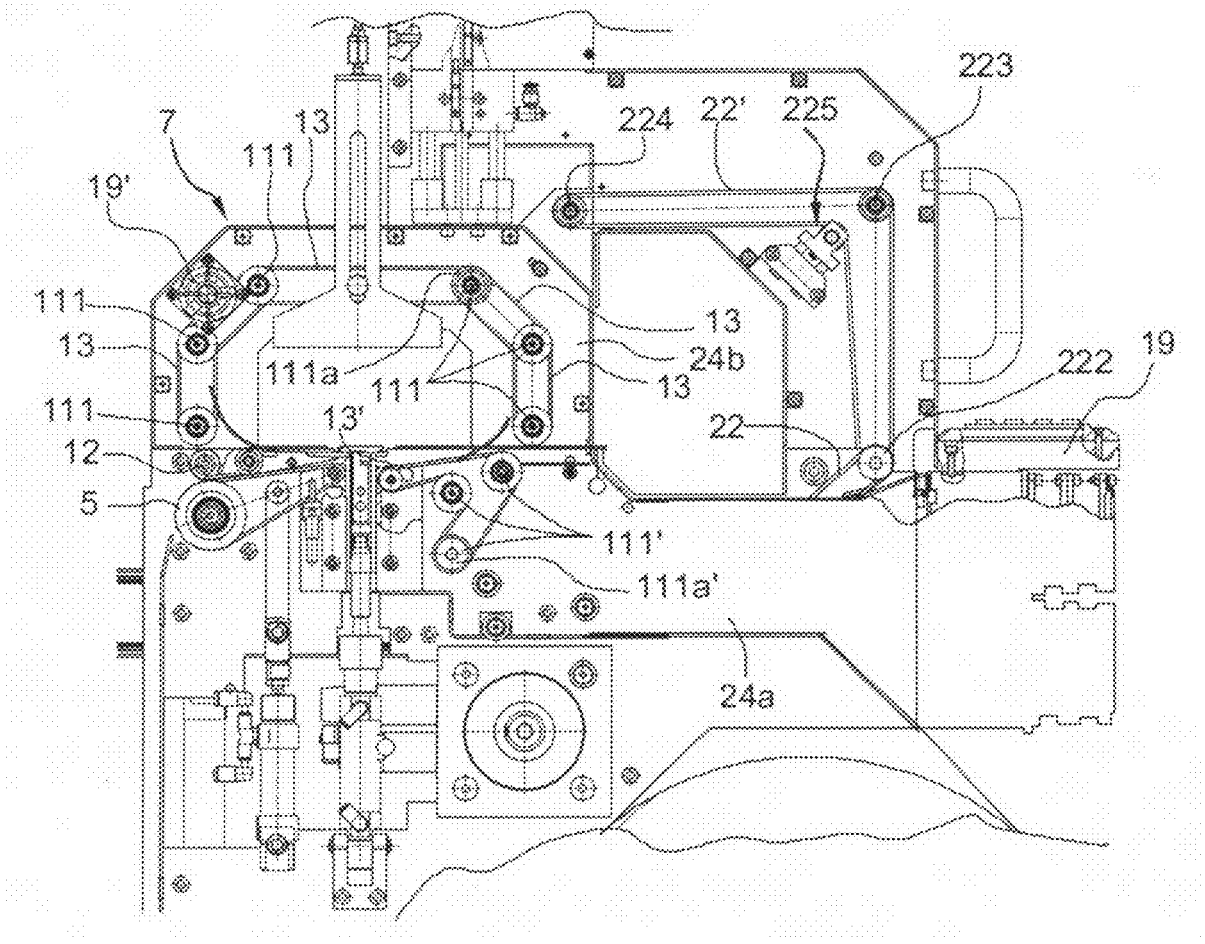

As schematically illustrated in FIG. 1*b*, the upper transfer belt mechanism 22', 222, 223, 224 is further provided with a belt tensioner mechanism 225 to compensate for the upward-downward movement of the means for forming a loop 7. Tensioner mechanism 225 basically comprises a displaceable roller that acts on belt 22' so as to adapt the level of tension in the belt 22'. Indeed, since roll 224 follows the vertical movement of the means for forming the loop 7, this causes a variation of the tension in belt 22' due to the relative displacement of roll 224 with respect to the other rolls 222 and 223, and tensioner mechanism 225 compensates for this variation in the belt tension.

As illustrated in the Figures, the banding system exhibits a generally planar configuration which coincides (i.e., is aligned) with the plane in which the band material 2 is transported. This planar configuration of the banding system advantageously allows for several banding systems to be disposed in parallel, in a compact manner, one next to the other, so as to simultaneously perform several banding operations of strip-shaped products, such as strips of piled banknotes which have previously been cut out from a pile of banknote-bearing sheets.

Attached to the means for forming a loop 7 there is in addition a pressure means 10 formed, for example, by a pressure stamp, which may also have a relative motion of its own with respect to the means for forming a loop 7. The pressure stamp is guided on the means for forming a loop by a guiding aperture 20 and is moved by appropriate means, for example a piston 21. This pressure stamp 10 is used to apply pressure on the products being banded during the banding operation.

Figure 2:
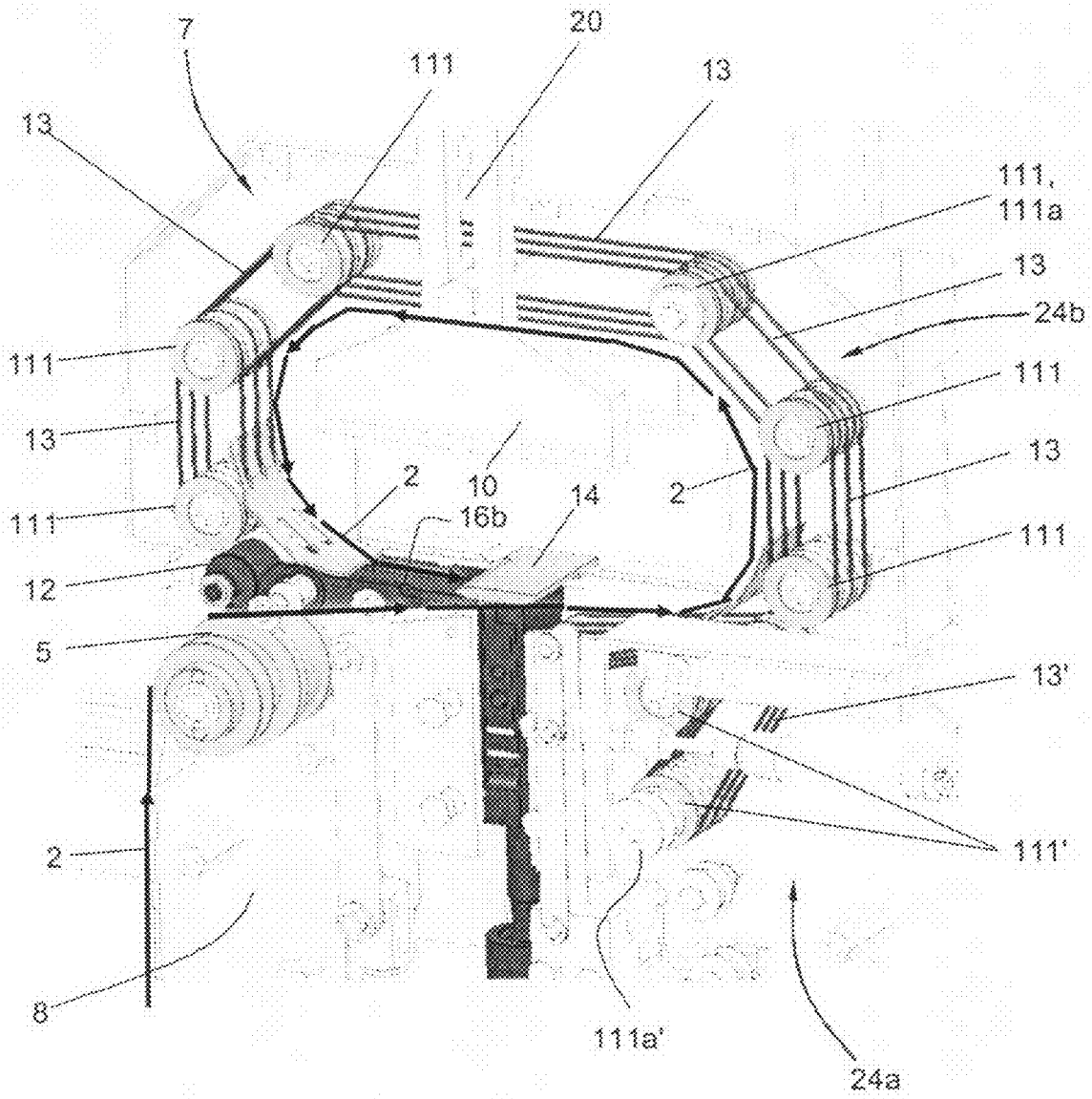
FIG. 2 shows a more detailed perspective view of the banding system.

In FIGS. 1*b* and 2, the feed mechanism 6 and the means for forming a loop 7 are disclosed in more detail. In this FIGS. 1*b* and 2, lateral covers of the machine frame 8 and of the means for forming the loop 7 have been omitted to show the various band transport components. The feed mechanism 6 comprises mainly the drive roll 5 which drives the band 2 into the means for forming a loop 7. Thanks to the transfer belt mechanisms, rotation of the drive roll 5 is synchronized with that of rolls 111, 111' of transporting means. A first set of rolls 111 constitutes the transporting means of the means for forming the loop 7 and is driven, as already explained, via roll 111*a* and the transfer belt mechanisms 22, 22', 222, 223, 224. A second set of rolls 111' constitutes additional transporting means which are located in the machine frame 8, one 111*a'* of the rolls 111' being drivingly connected to transfer belt 22 as illustrated in FIGS. 1 and 1*a*. The feed mechanism 6 further comprises a pressure roll 12 which cooperates with the drive roll 5 in order to exert pressure on the band material 2 (indicated schematically by arrows in FIG. 2) which is fed between drive roll 5 and pressure roll 12. The purpose of this pressure roll 12 is to assist feeding of the band material 2 during the banding operation.

All rolls 111 in the means for forming the loop 7 are linked to each other by conveyor means 13, for example rubber rings (O-rings). Similarly, the additional rolls 111' in the machine frame 8 are linked to each other by separate conveyor means 13'. The functioning of the transporting means is similar to the one of the device disclosed in WO 95/19913 and reference is made to this publication for description purposes. As described in this document, the transporting means are subjected to vacuum through a main vacuum pump 19 and, optionally, an auxiliary vacuum pump 19' which are located in a vacuum channel 24 (see FIGS. 1 and 1*b*). The pumps 19, 19' and vacuum channel 24 allow to press the band 2 against the conveyor means 13 (and 13') during its transport and ensure a proper formation of the loop around the products. The path of the band 2 is schematically shown on FIG. 2.

In the present embodiment, the vacuum channel 24 includes a first channel portion 24*a* located in the machine frame 8 and a second channel portion 24*b* located inside the means for forming the loop 7 and which connects to the first channel portion 24*a* during the banding operation. The main vacuum pump 19 is coupled to the first channel portion 24*a*, while the optional auxiliary vacuum pump 19' is coupled to the second channel portion 24*b*.

As this is apparent in FIGS. 1, 1*a*, 1*b* and 2, the means for forming the loop 7 are constructed as a part which generally has an inverted U-shape, the interior space of which is adapted to surround the products to be banded. The second channel portion 24*b* of channel 24 (the shape of which generally conforms to the inverted U-shape of the means for forming the loop 7) is open on an inside area of the U-shaped part where the band material 2 is to be transported. The second channel portion 24*b* is further open at the extremity of the U-shaped part which connects, during the banding operation, with a corresponding open extremity of the first portion 24*a* of channel 24 which is located in the machine frame 8. When the means for forming the loop 7 are lowered onto the feed mechanism 6 (as illustrated in FIGS. 1 and 2), the two channel portions 24*a*, 24*b* of vacuum channel 24 are connected together and vacuum can be applied around the band material 2 to ensure an adequate transport thereof.

When the means for forming a loop 7 are lifted with respect to the feed mechanism along the rail means 9 (see FIG. 1), an opening is created on the left side of the system represented in FIG. 2, said opening allowing a transfer of a product to be banded from the left side of the system represented in FIG. 2 under the means for forming a loop 7. The created opening thus allows products to be banded to be inserted in the banding position, between the means for forming the loop 7 and the band feed mechanism 6, along a direction which is parallel to the plane in which the band material 2 is transported, rather than laterally (i.e., along a direction which is perpendicular to the plane in which the band material is transported).

Figure 3:
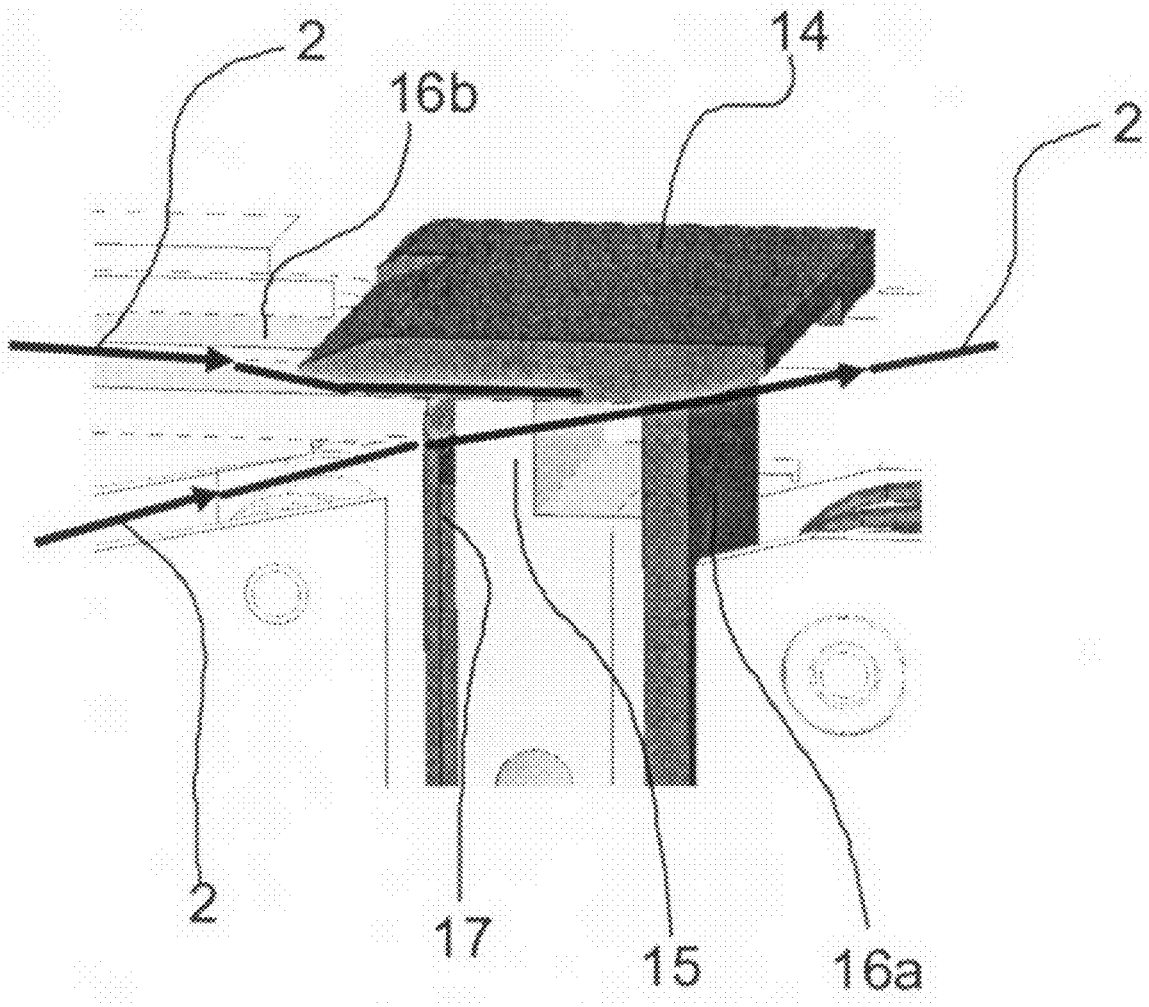
FIG. 3 shows a detailed view of the means for closing the loop.

The welding means for closing the loop are illustrated in more detail in FIG. 3. These welding means comprise a heating stamp counter piece 14, under which are situated a heating stamp 15, a clamping part 16*a*, a cutting means 17 and a clamping plate 16*b*. As shown in FIGS. 2 and 3, the band material 2 is fed between the counter piece 14, on the one hand, and the heating stamp 15, the clamping part 16*a* and the cutting means 17, on the other hand.

A new reel 1 of band material 2 is mounted as follows in the banding system. The reel 1 is mounted on its reel support 1*a* and a piece of band material 2 is unwound from the reel 1. The free end is first fed through the band storage 3, 4 and then to the drive roll 5 as illustrated in FIG. 1. The band material 2 is advanced manually until the free end thereof is fed between the clamping part 16*a* and the counter piece 14 (heating stamp 15, clamping part 16*a* and cutting means 17 being in a lowered position). The clamping part 16*a* is thereafter raised to clamp the free end of the band material 2 against the counter piece 14, and the storage rolls 3, 4 are commanded to draw and store the adequate length of band material 2 from band reel 1 (rolls 3 are in particular driven downwards during this operation). After the appropriate length of band material 2 has been stored in the band storage 3, 4, the cutting means 17 is briefly activated so as to cut the excess portion of band material 2. During this operation, the pressure roll 12 is pushed against the drive roll 5 to clamp the band material therebetween. The clamping part 16*a* is then lowered, the banding system being now ready for the banding operation.

The banding operation occurs as follows. Once the products to be banded are transferred to the banding position (the middle part, width-wise, of the products to be banded overlying the welding means), the pressure stamp 10 is driven downwards and applies pressure on the products to be banded; simultaneously, the means for forming the loop 7 are moved downwards to connect both portions of the vacuum channel 24 and thereby create a closed transporting channel around the products to be banded.

A determined length of band material 2 is then advanced by the band feed mechanism 6 under action of the drive roll 5 and associated pressure roll 12. During this process, rotation of the reel support 1*a* and band reel 1 is prevented by means of the brake system 1*b* and the necessary amount of band material 2 is taken from the available material stored in the band storage 3, 4. In the process, storage rolls 3 are driven upwards.

The vacuum generated by the main and auxiliary pumps 19, 19' in the vacuum channel 24 presses the band material 2 against the conveyor means 13, 13' and the band material 2 is accordingly drawn along its whole length in a secure manner. Thanks to the close contact between the band material 2 and the conveyor means 13, 13' and the synchronized driving of the rolls 111, 111' with that of the drive roll 5, the band material 2 is frictionally driven along its whole length. As soon as the determined length of band material 2 is advanced in the system, the free end of the band material 2 is fed over clamping plate 16*b* and comes in overlap relationship with the other part of the band material 2, under the counter piece 14.

Once the loop has been formed around the products to be banded and the free end of the band material 2 is fed under the counter piece 14, as schematically illustrated in FIGS. 2 and 3, the clamping plate 16*b* is raised against the counter piece 14 in order to clamp the free end of the band material 2. Shortly after, the pressure roll 12 is lifted off away from the drive roll 5, and the storage rolls 3, 4 are activated (rolls 3 being driven downwards) in order to draw the band material 2 slightly backwards so that the loop of band material is tightened around the products. A sensor is preferably provided to signal if the band material is properly pulled tight. Once the band material is pulled tight, the pressure roll 12 is again pushed against drive roll 5.

Next, the clamping part 16*a* is displaced against the counter piece 14 to clamp a second side of the band material 2, followed by the cutting means 17 which performs cutting of the band material 2; the heating stamp 15 is thereafter displaced by means of for example a piston 18 (FIG. 1) and brought into contact with the band material 2 and the counter piece 14 in order to weld the two extremities of the created loop of band material 2 against one another by applying heat thereto. Once the welding is done (following a short welding time), the piston 18 is driven backwards and the assembly comprising heating stamp 15, clamping part 16*a*, cutting means 17 and clamping plate 16*b* are displaced away from counter piece 14. The means for forming a loop 7 and the pressure means 10 are preferably also retracted at the same time.

The control of the proper closing of the band may now be carried out. Such a control can be carried out optically with a light ray controlling whether both ends of the loop are properly attached to each other. This can be carried out by an illumination device and photo-sensor suitably located near the welding point.

If the loop is correctly closed, the banded products are now ready to be taken away. The counter piece 14 is however still enclosed within the loop of band material. The banded products are thus moved laterally in order to free the loop of band material from the counter piece 14. To this effect, a transverse pusher (not shown) is positioned at one end of the banded products and pushes laterally said banded products on a distance at least equal to the width of the band until the counter piece 14 is freed from the band. Once this movement has been carried out, the banded products may be taken away for further processing, such as trimming, cutting, collecting etc.

The transverse pusher can be actuated by appropriate means, for example by air under pressure.

During the welding process, the storage rolls 3, 4 are further activated in order to unwind the length of band material 2 required for the next banding operation. During this process, the brake system 1*b* is released so as to allow rotation of the reel support 1*a* and band reel 1, while the free end of the band material 2 is clamped. Once the required length of band material 2 is stored by storage rolls 3, 4, the brake system 1*b* is again activated to prevent any rotation of the band reel 1. The banding system is then ready to receive the next products to be banded and perform the required banding operation.

Of course, the described embodiments of the machine and process are not to be construed in a limiting manner and are only given as examples. Equivalent means and steps can be derived from the present description. For instance, drive means other than pistons or pneumatic driving means, such as electric motors, could be used in order to perform the necessary displacement of the functional components of the banding system.

The invention claimed is:

1. A banding system for piled products, such as securities, banknotes, checks and other similar documents comprising:

a machine frame, a band feed mechanism disposed on said machine frame for feeding band material from a supply roll, means for forming a loop with said band material around the products to be banded while the products to be banded remain stationary, attachment means for attaching the band material to form a closed loop, and cutting means for cutting said band material once the closed loop is formed, said means for forming the loop comprising transporting means for transporting the band material around the product to be banded and vacuum means connected to the transporting means for generating vacuum around said band material while it is transported around the products to be banded, thereby pressing the band material against the transporting means, wherein said means for forming the loop are movable with respect to the machine frame between an operating position where said means for forming the loop are in contact with said band feed mechanism to perform the banding operation and an open position where said means for forming the loop are displaced away from the band feed mechanism to create an opening therebetween allowing a transfer of products to be banded between the band feed mechanism and the means for forming the loop.

2. A banding system as claimed in claim 1, wherein said means for forming the loop are movable in translation with respect to the band feed mechanism.

3. A banding system as claimed in claim 2, wherein said means for forming the loop are displaceable on said machine frame through sliding rail means disposed on said machine frame.

4. A banding system as claimed in claim 1, wherein said means for forming the loop are displaced by means of a piston.

5. A banding system as claimed in claim 1, wherein said transporting means comprise a plurality of transporting rolls connected by conveyor means.

6. A banding system as claimed in claim 5, wherein said conveyor means are rubber rings.

7. A banding system as claimed in claim 1, wherein said transporting means and said band feed mechanism are driven synchronously by means of a transfer belt mechanism.

8. A banding system as claimed in claim 1, further comprising a pressure means for applying pressure on said products during the banding operation.

9. A banding system as claimed in claim 8, wherein said pressure means is formed of a pressure stamp which is guided on the means for forming the loop and is displaceable with respect to the means for forming the loop.

10. A banding system as claimed in claim 1, wherein said vacuum means include a vacuum channel and means for generating vacuum into said vacuum channel in order to press said band material against said transporting means during transport of the band material around said products.

11. A banding system as claimed in claim 10, wherein said vacuum channel includes a first channel portion located in said machine frame and a second channel portion located inside said means for forming the loop and which connects to the first channel portion during the banding operation.

12. A banding system as claimed in claim 11, wherein said means for generating vacuum into said vacuum channel include a main vacuum pump (19) coupled to the first channel portion.

13. A banding system as claimed in claim 12, wherein said means for generating vacuum into said vacuum channel further include an auxiliary vacuum pump coupled to the second channel portion.

14. A banding system as claimed in claim 11, wherein said means for forming the loop are constructed as a part substantially having an inverted U-shape and wherein the second channel portion located in said means for forming the loop is open on an inside area of the U-shaped part, where the band material is transported, and at one extremity of the U-shaped part which connects, during the banding operation, with a corresponding open extremity of the first channel portion located in said machine frame.

15. A banding system as claimed in claim 1, further comprising a pusher for moving laterally the banded products after the banding operation and freeing the banded products from the attachment means once the closed loop is formed and the band material is cut.

16. A banding system according to claim 1, having a substantially planar configuration which is substantially aligned with the plane in which said band material is transported.

17. A banding process for piled products, such as securities, banknotes, checks and other similar documents comprising the following steps:

a) displacing products to be banded onto a banding system comprising a band feed mechanism and means for forming a loop with band material around said products to be banded;

b) transporting band material around said products to be banded while the products to be banded remain stationary;

c) generating vacuum around said band material while it is transported around the products to be banded;

d) attaching the band material to form a closed loop; and e) cutting the band material once the closed loop is formed, wherein said step of displacing the products onto the banding system includes:

a1) displacing the means for forming the loop away from the band feed mechanism to create an opening therebetween;

a2) transferring the products to be banded through the opening between the band feed mechanism and the means for forming the loop; and a3) displacing the means for forming the loop to get into operating contact with the band feed mechanism and allow the banding operation to take place.

18. A banding process as claimed in claim 17, wherein the step of attaching the band material is made by welding or by glueing.

19. A banding process as claimed in claim 17, further comprising the step of evacuating the banded products once the closed loop is formed and the band material is cut.

20. A banding process as claimed in claim 17, wherein the displacement of the means for forming a loop with band material with respect to the band feed mechanism is made by translation.

21. A banding process as claimed in claim 17, wherein the means for forming a loop with band material are displaced with respect to the band feed mechanism before and/or after the banding operation.

22. A banding process as claimed in claim 19, wherein, after formation of the closed loop and cutting of the band material, the banded products are moved laterally so as to free the banded products from attachment means used for attaching the band material.

23. A banding process as claimed in claim 17, further comprising the step of applying pressure onto said products during the banding operation.

24. A banding machine comprising a plurality of banding systems as defined in claim 1, said banding systems being placed one next to the other.

* * * * *